US008307816B2

(12) United States Patent
Darlington

(10) Patent No.: US 8,307,816 B2
(45) Date of Patent: Nov. 13, 2012

(54) COMPOUND ARCHERY BOW WITH NON-LINEAR CABLE GUIDE

(76) Inventor: Rex F. Darlington, Whittemore, MI (US)

( * ) Notice: Subject to any disclaimer, the term of this patent is extended or adjusted under 35 U.S.C. 154(b) by 387 days.

(21) Appl. No.: 12/657,689

(22) Filed: Jan. 26, 2010

(65) Prior Publication Data

US 2010/0132683 A1 Jun. 3, 2010

(51) Int. Cl.
*F41B 5/10* (2006.01)
*F41B 5/14* (2006.01)

(52) U.S. Cl. ..... 124/88; 124/1; 124/23.1; 124/25; 124/25.6; 124/86; 124/90

(58) Field of Classification Search ..... 124/1, 23.1, 124/25, 25.6, 86, 88, 90
See application file for complete search history.

(56) References Cited

U.S. PATENT DOCUMENTS 4,377,152 A * 3/1983 Saunders ..... 124/88
4,452,222 A * 6/1984 Quartino et al. ..... 124/23.1
4,478,203 A * 10/1984 Hayes ..... 124/25.6
4,596,228 A * 6/1986 Smith ..... 124/25.6
4,741,320 A * 5/1988 Wiard ..... 124/23.1
4,846,142 A * 7/1989 Tone ..... 124/90
4,886,038 A * 12/1989 Betters ..... 124/25.6
4,903,678 A * 2/1990 Walker ..... 124/90
4,917,070 A * 4/1990 Townsend ..... 124/23.1
4,919,108 A * 4/1990 Larson ..... 124/88
4,961,264 A * 10/1990 Topel ..... 33/265
5,103,798 A * 4/1992 McGraw et al. ..... 124/88
5,161,514 A * 11/1992 Cary ..... 124/24.1
5,178,122 A * 1/1993 Simonds ..... 124/25.6
5,392,757 A * 2/1995 Head et al. ..... 124/86
5,415,149 A * 5/1995 Derus et al. ..... 124/23.1
5,464,002 A * 11/1995 Lavoie et al. ..... 124/86
5,531,211 A * 7/1996 Wilfong, Jr. ..... 124/86
5,553,600 A * 9/1996 Miller ..... 124/86
5,687,701 A * 11/1997 Henry ..... 124/1
5,762,060 A * 6/1998 Larson ..... 124/88
5,791,324 A * 8/1998 Johnson ..... 124/25.6
5,979,425 A * 11/1999 Loomis ..... 124/25.6
5,983,880 A * 11/1999 Saunders ..... 124/25.6
6,173,707 B1 * 1/2001 Howell et al. ..... 124/88
6,532,945 B1 * 3/2003 Chattin ..... 124/25.6
6,715,481 B1 * 4/2004 Anderson ..... 124/88
6,722,354 B1 * 4/2004 Land ..... 124/25.6
6,796,037 B1 * 9/2004 Geffers et al. ..... 33/265
7,066,165 B2 * 6/2006 Perry ..... 124/23.1
2010/0083943 A1 * 4/2010 Grace et al. ..... 124/25.6
2010/0101549 A1 * 4/2010 Grace et al. ..... 124/25.6
2010/0132685 A1 * 6/2010 De Sousa ..... 124/88
2010/0224178 A1 * 9/2010 McPherson ..... 124/25.6

(Continued)

*Primary Examiner* — Gene Kim
*Assistant Examiner* — Alexander Niconovich
(74) *Attorney, Agent, or Firm* — Reising Ethington PC

(57) ABSTRACT

A compound archery bow includes a bow handle having at least one limb and a pulley rotatably mounted on the limb. A cable system includes a bowstring cable extending from the pulley and spaced from the handle for movement away from and toward the handle to propel an arrow, and at least one power cable extending from the pulley to control rotation of the pulley as a function of draw of the bowstring cable. A cable slide rod extends from the handle adjacent to the cable system. A cable slide is engaged with the power cable and slidable on the cable slide rod to hold the power cable away from the bowstring cable as the bowstring cable is drawn and released. The cable slide rod is non-linear, and preferably includes an end portion spaced from the handle that is curved toward the bowstring cable.

7 Claims, 4 Drawing Sheets

U.S. PATENT DOCUMENTS

2010/0282226 A1* 11/2010 Marzullo ..... 124/25.6
2011/0011385 A1* 1/2011 Grace et al. ..... 124/25.6
2011/0073090 A1* 3/2011 McPherson ..... 124/25.6
2011/0247602 A1* 10/2011 McPherson ..... 124/25.6
2011/0303204 A1* 12/2011 Gordon et al. ..... 124/25.6
2012/0042861 A1* 2/2012 Anselmo ..... 124/25.6

* cited by examiner

COMPOUND ARCHERY BOW WITH NON-LINEAR CABLE GUIDE

The present disclosure is directed to compound archery bows, and more particularly to a cable guide for guiding movement of the bow power cables as the bowstring is drawn and released:

BACKGROUND AND SUMMARY OF THE DISCLOSURE

Single-cam and dual-cam compound archery bows have a pulley mounted on one or both ends of the bow limbs to control the draw force on the bowstring and bending of the limbs as the bow is drawn. In single-cam bows, there is a power cam on the end of one bow limb and a wheel on the end of the other bow limb to facilitate control or take-up of a power cable at the power cam and let-out of the bowstring at the power cam as the bow is drawn. In dual-cam bows, power cams are mounted on the ends of both bow limbs. One or, more typically, two power cables extend from each power cam toward the opposing power cam or the opposing limb.

Compound archery bows typically also include a cable guide to hold the power cables away from the path of travel of the bowstring cable and the arrow propelled by the bowstring cable as the bowstring cable is drawn and released. The cable guide typically includes a cable guide rod fixedly or adjustably mounted to the bow handle and extending away from the handle adjacent to the power cables. A cable slide is engaged by the power cable(s) and slides along the rod to hold the power cable(s) out of the path of travel of the bowstring cable and the arrow propelled by the bowstring cable.

It has become a trend for target shooters to use large-diameter arrow shafts when shooting target because they increase the chance that the outer diameter of the shaft will cut a higher score ring on the target. However, such large-diameter shafts can cause a problem because the arrow fletchings can interfere with the power cable(s). The cable guide rod and cable guide can be offset to address the problem of clearance for the shaft and the fletchings as the arrow passes the power cables when the bowstring is drawn and released. However, such additional offset increases the angle of the power cable as it leaves the groove on the power cam, causing excessive wear on the cable. Additional offset of the cable slide rod can also cause the power cable to make inadequate contact with a draw stop on the pulley at full draw because of the cable angle as the cable leave the pulley. At full draw the cable tension greatly increases and any additional offset of the cable guide to get more shaft and fletching clearance increases the torque on the bow limbs.

A general object of the present disclosure is to provide a cable guide arrangement that addresses one or more of these potential problems. Another general object of the present disclosure is to provide a cable guide system that can be mounted on a pre-existing bow and achieve the foregoing objective.

The present disclosure embodies a number of aspects that can be implemented separately from or in combination with each other.

A compound archery bow, in accordance with one aspect of the present disclosure, includes a bow handle having at least one limb and a pulley rotatably mounted on the limb. A cable system includes a bowstring cable extending from the pulley and spaced from the handle for movement away from and toward the handle to propel an arrow. At least one power cable extends from the pulley to control rotation of the pulley as a function of draw of the bowstring cable. A cable slide rod extends from the handle adjacent to the cable system. A cable slide is engaged with the power cable and slidable on the cable slide rod to hold the power cable away from the bowstring cable as the bowstring cable is drawn and released. The cable slide rod is non-linear, and preferably includes an end portion spaced from the handle that is curved toward the bowstring cable.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
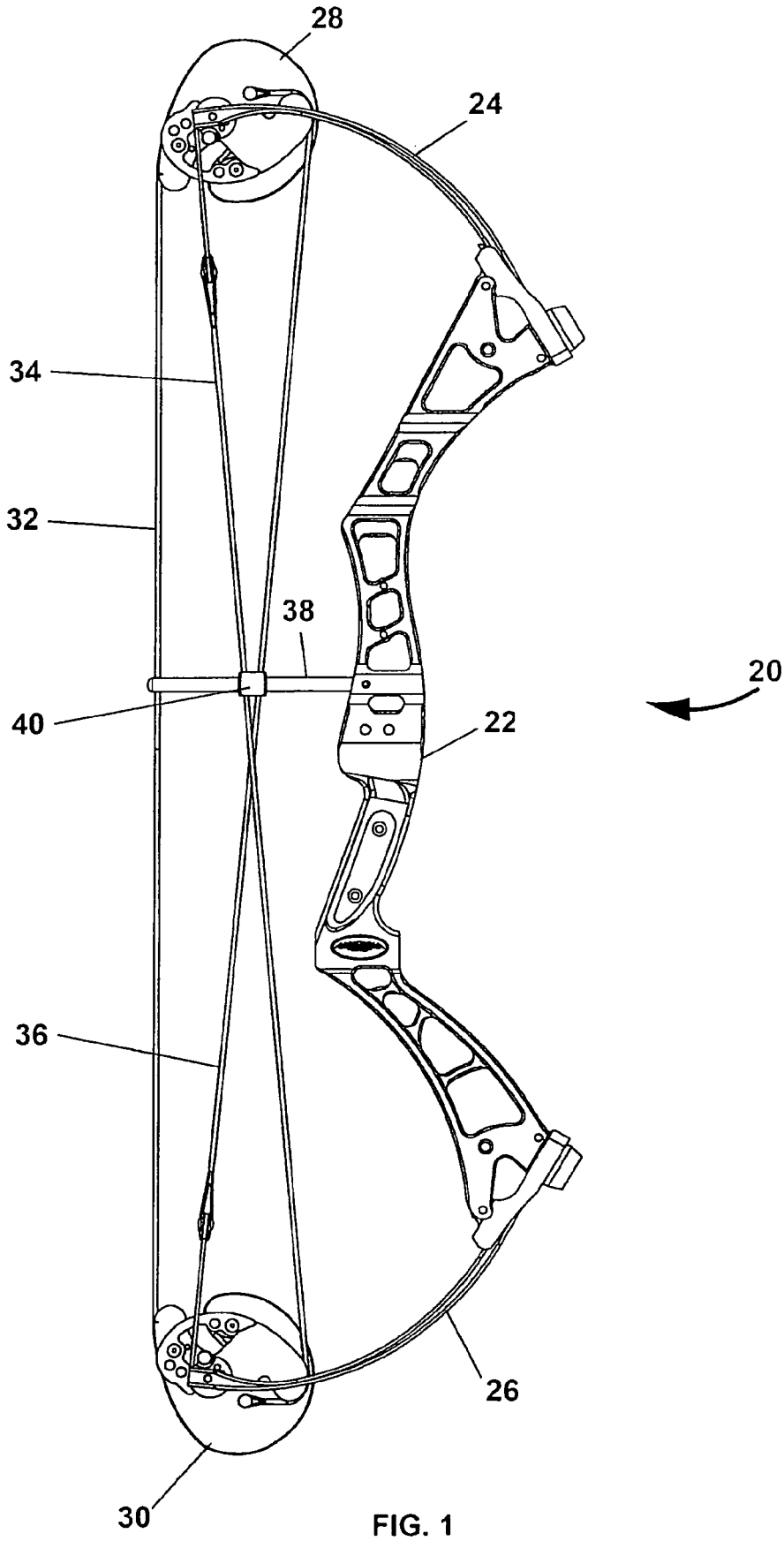
FIG. 1 is a side elevational view of a compound archery bow in accordance with an exemplary embodiment of the present disclosure.

FIG. 1 illustrates a dual-cam compound bow 20 in accordance with one exemplary embodiment of the present disclosure as including a handle 22 of aluminum or other relatively rigid construction having spaced risers and bow-mounting surfaces at each end. A pair of flexible resilient limbs 24, 26 of fiber-reinforced resin or other suitable resilient construction are mounted on the respective handle risers and project away from handle 22. An upper pulley 28 is mounted for rotation on an end of limb 24, and a lower pulley 30 is mounted for rotation on an end of limb 26. Bow 20 in the exemplary embodiment of FIG. 1 is a dual-cam bow in which pulleys 28, 30 are power cams that are similar in function and preferably near mirror images of each other.

A bowstring cable 32 extends between pulleys 28, 30. A first power cable 34 extends from pulley 28 toward pulley 30, and a second power cable 36 extends from pulley 30 toward pulley 28. As bowstring cable 32 is drawn away from handle 22 from the rest position of FIG. 1 toward a fully drawn position, power cables 34, 36 control rotation of the respective pulleys. Pulleys 28, 30 can be of any suitable construction. As an alternative to the dual-cam bow in FIG. 1, the bow may comprise a single-cam bow of the type illustrated in U.S. Pat. No. 5,934,265, for example, in which one of the pulleys is a wheel rather than a power cam, and the power cables control rotation of the wheel (and the power cam) as a function of bow draw. It also is within the scope of the present disclosure to provide a single-cam bow in which there is a single power cable that is anchored to the bow limb opposite the pulley. In short, there is at least one and preferably two power cables that pass adjacent to the area of the arrow path, and which must be held out of the way of the bowstring cable and the arrow. In some implementations of the disclosure, the cables may include a control cable or a bowstring cable as it returns to the power cam, as in a single cam bow.

Figure 2:
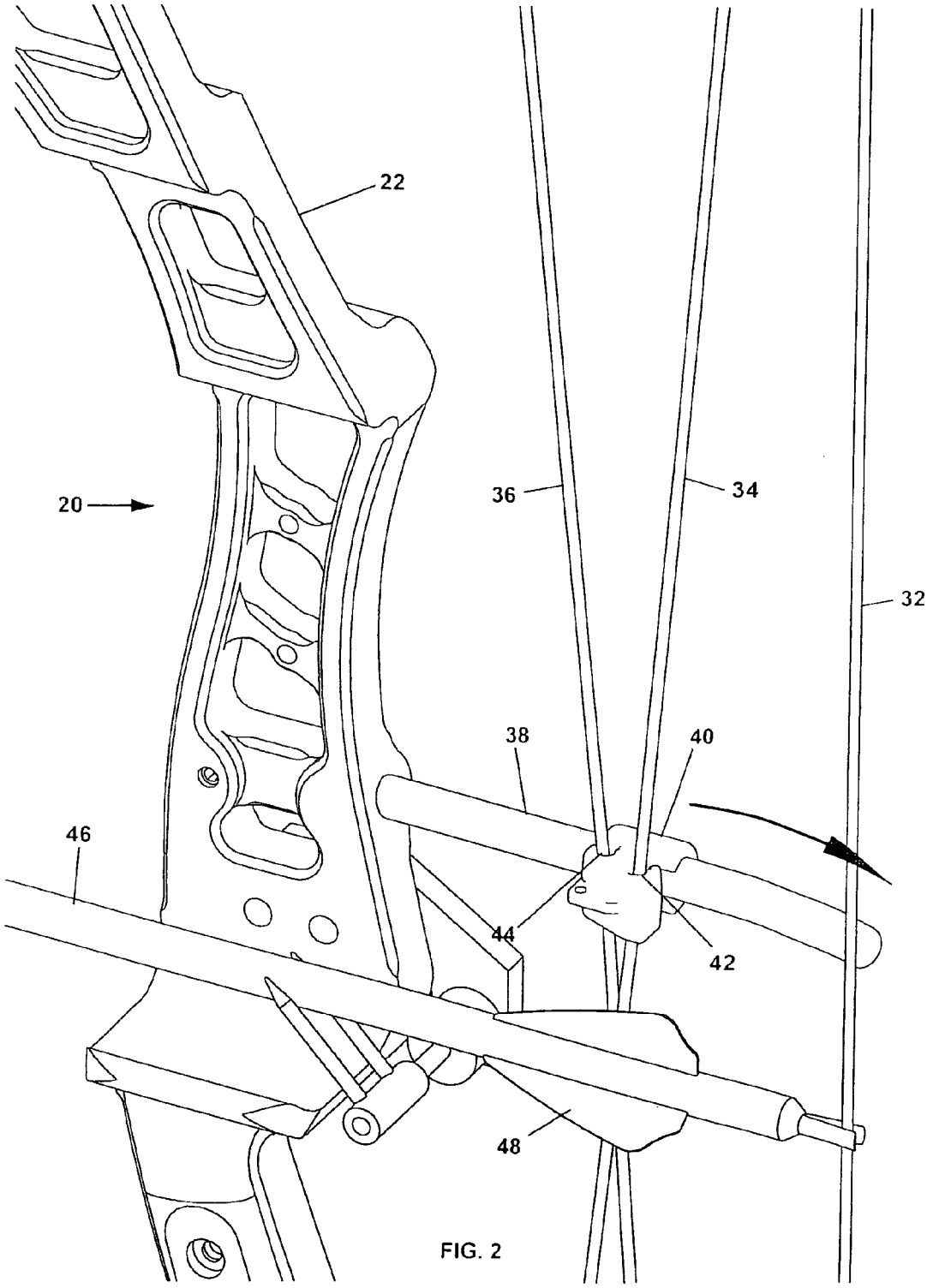
FIG. 2 is a fragmentary perspective view of a portion of the bow in FIG. 1 with the bowstring cable undrawn.
Figure 3:
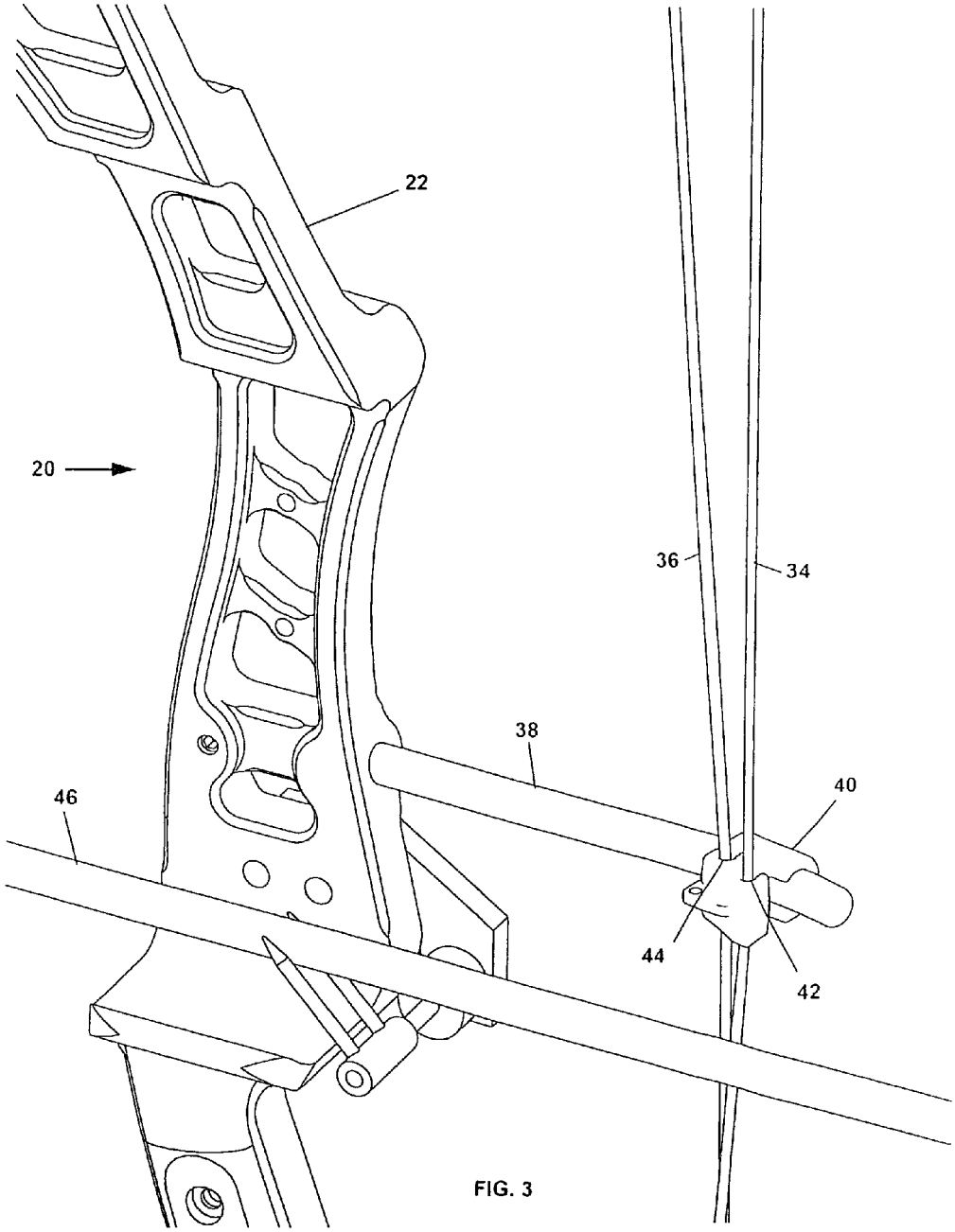
FIG. 3 is a fragmentary perspective view of the portion of the bow illustrated in FIG. 2 but with the bowstring cable fully drawn.

For this purpose, a cable slide rod extends from handle 22 and passes adjacent to power cables 34, 36. Cable slide rod 28 preferably is circular in cross section, and may be either fixedly or adjustably mounted to handle 22. A cable slide 40 is slidably mounted on rod 38. As best seen in FIGS. 2 and 3, slide 40 has notches 42, 44 that receive power cables 34, 36. As bowstring cable 32 is drawn from the rest position of FIGS. 1 and 2 toward the fully drawn position of FIG. 3, slide 40 moves along rod 38 and holds cables 34, 36 out of the way of arrow shaft 46 and fletchings 48.

Figure 4:
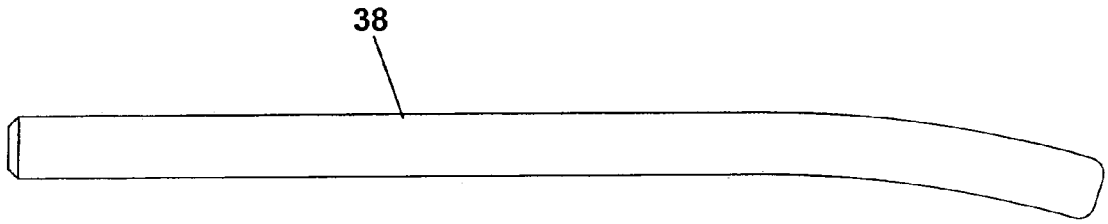
FIG. 4 is a plan view of a cable guide rod in accordance with the exemplary embodiment of the disclosure.

In accordance with the present disclosure, cable slide rod 38 is non-linear, as best seen in FIGS. 2-4. Cable slide rod 38 preferably has an end portion that extends toward, preferably curves toward, bowstring cable 32. Thus, as bowstring cable 32 is drawn from the rest position of FIG. 2 toward the fully drawn position of FIG. 3, cable slide 40 and power cables 34, 36 move inward toward the path of travel of bowstring cable 32 and arrow shaft 46 after fletchings 48 have cleared the power cable area. This reduces the angles at which power cables 34, 36 leave pulleys 28, 30 (FIG. 1), reducing cable wear and reducing torque on limbs 24, 26. When the bowstring cable is released to propel the arrow, cable slide 40 moves back to the linear portion of the rod out of the way of the cables and fletchings. Cable slide rod 38 preferably is of one-piece construction, and preferably includes a linear portion extending from handle 22 and a curved portion on the end of linear body portion. Cable slide rod 38 preferably would be adjustably mounted on the bow handle.

There thus has been disclosed a compound archery bow and a cable slide system that fully satisfy all of the objects and aims previously set forth. The bow and system have been disclosed in conjunction with exemplary embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:

a bow handle having at least one limb, a pulley rotatably mounted on said at least one limb, a cable system that includes a bowstring cable extending from said pulley and spaced from said handle for movement toward and away from said handle to propel an arrow, and at least one power cable extending from said pulley to control rotation of said pulley as a function of draw of said bowstring cable, a cable slide rod extending from said handle adjacent to said cable system, and a cable slide engaged with said at least one power cable and slidably mounted on said cable slide rod to hold said at least one power cable away from said bowstring cable as said bowstring cable is drawn and released, wherein said cable slide rod is non-linear, and said cable slide is positioned on said cable slide rod to slide along a non-linear portion of said rod as said bowstring cable is drawn.

2. The bow set forth in claim 1 wherein said cable slide rod extends toward said bowstring cable.

3. The bow set forth in claim 2 wherein said cable slide rod has a linear portion extending from said handle, and a non-linear end portion spaced from said handle that curves toward said bowstring cable and along which said cable slide slides.

4. The bow set forth in claim 1 wherein an end portion of said cable slide rod spaced from said handle is curved toward said bowstring cable.

5. The bow set forth in claim 4 including first and second limbs mounted on said handle, first and second pulleys respectively rotatably mounted on said limbs, and first and second power cables respectively extending from said pulleys through said cable slide.

6. A cable guide system for a compound archery bow having a handle and at least one power cable, said system including:

a cable slide rod for mounting on the handle, and a cable slide for slidable mounting on the cable slide rod and having at least one notch for engaging the at least one power cable, wherein said cable slide rod is non-linear, and said cable slide is positioned on said cable slide rod to slide along a non-liner portion of said rod.

7. The system set forth in claim 6 wherein said cable slide rod has a curved end portion on which said slide is positioned to slide.

* * * * *